US005996444A

United States Patent [19]

Pearce et al.

[11] Patent Number: 5,996,444

[45] Date of Patent: Dec. 7, 1999

[54] APPARATUS FOR UNSCREWING DRILL PIPE SECTIONS

[75] Inventors: Richard J. Pearce; William C. Grindstaff, both of Gainesville; James D. Madden, Micanopy, all of Fla.

[73] Assignee: Driltech Inc., Alachua, Fla.

[21] Appl. No.: 08/961,226

[22] Filed: Oct. 30, 1997

[51] Int. Cl.[6] ..... B25B 17/00

[52] U.S. Cl. ..... 81/57.19; 81/57.2; 81/57.34

[58] Field of Search ..... 81/57.16, 57.19, 81/57.2, 57.3, 57.34

[56] References Cited

U.S. PATENT DOCUMENTS 3,771,389 11/1973 Coyne ..... 81/57.16 X
3,980,143 9/1976 Swartz et al. ..... 81/57.16 X
4,194,419 3/1980 Mitchhart et al. .
4,494,425 1/1985 Shewmake ..... 81/57.34
5,791,206 8/1998 Daigle et al. ..... 81/57.2 X

*Primary Examiner*—James G. Smith
*Attorney, Agent, or Firm*—Burns, Doane, Swecker & Mathis, L.L.P.

[57] ABSTRACT

Pipe sections of a drill string are unscrewed by holding one pipe section stationary in a clamping arm, and rotating another pipe section by a turning wrench. The clamping arm includes an adapter that can be replaced by similar adapters sized for different pipe diameter. The turning wrench includes a lug arranged to be contacted by a piston rod and rotated thereby for breaking the bond between the pipe sections.

12 Claims, 3 Drawing Sheets

APPARATUS FOR UNSCREWING DRILL PIPE SECTIONS

BACKGROUND OF THE INVENTION

The present invention relates to the handling of pipe sections of a drill string and, in particular to an apparatus for untightening the pipe sections.

A conventional drill rig typically includes a platform on which a mast is mounted. The mast carries a rotary head that is mounted for rotation and vertical movement relative to the mast. The rotary head is able to rotate and feed a drill string formed of pipe sections that are interconnected by screw threads. A pipe storage rack is sometimes mounted on or in the mast for receiving and dispensing pipe sections. The pipe sections are screwed together and fed into a bore hole. When it becomes necessary to pull drill string from the bore hole, the drill string is raised and the pipe sections are sequentially unscrewed from one another.

In a typical unscrewing operation, a first drill pipe section is rotated, while an adjacent second pipe section is held stationary. If the pipe sections are so tightly screwed together that they resist initial unscrewing efforts, special measures must be taken. For instance, one known untightening apparatus (e.g. see U.S. Pat. No. 4,194,419) includes an arm having multiple, relatively pivotable sections for rotating first pipe section, while a pair of jaws spaced vertically from the arm is provided for holding the second pipe section stationary.

The arm includes a main section mounted to a vertical post for rotation about a vertical axis of the post, an intermediate section mounted to the first section for rotation about a vertical axis defined by the drill pipe section, and a clamping section mounted on the second section for rotation about a vertical axis, whereby the first drill pipe section is gripped between the intermediate and clamping sections. A fluid cylinder interconnecting the main and intermediate sections rotates the intermediate section, the clamping section, and the first drill pipe section about the vertical axis of the first drill pipe section.

While this occurs, the two jaws, diametrically spaced from one another, are driven toward one another to engage non-cylindrical portions (e.g. flats) of an outer periphery of the second drill pipe section and thereby prevent the second drill pipe section from rotating.

The above-described arrangement has certain limitations, because the clamping section of the arm may not be ideally dimensioned for clamping pipe sections of different diameters. Also, the arm is of relatively complex structure due to the need to provide for relative pivotal movement between three arm sections.

Therefore, it would be desirable to provide an untightening mechanism and method which is of simplified, yet effective construction, and can be adapted to different diameters of pipe sections.

SUMMARY OF THE INVENTION

The present invention relates to an apparatus for unscrewing first and second threaded sections of a drill string from one another. The apparatus includes an arm mounted for rotation about a first vertical axis, the arm forming a first recess. A first actuating mechanism is provided for rotating the arm about the first axis. An adapter is removably mounted on the arm for clamping the first pipe section. The adapter includes a generally U-shaped body including a pair of legs interconnected by a base. The legs are spaced apart and define therebetween a second recess coinciding with the first recess for receiving the first pipe section. The body is removably mounted to the arm by fasteners. The base carries serrated pipe-engaging surfaces. First and second clamping cams are mounted on free ends of respective ones of the legs for rotation about second and third vertical axes, respectively, from a retracted position to a clamping position for clamping the first pipe section against the serrated surfaces, to prevent movement thereof. A second actuating mechanism is mounted on the arm and is removably connectable to the first and second clamping cams for rotating the clamping cams between the retracted and clamping positions. The adapter is replaceable in response to being disconnected from the arm and from the second actuating mechanism. A turning mechanism is provided for rotating the second pipe section while the first pipe section is clamped immovably by the arm.

The present invention also relates to the clamping mechanism per se, and to the turning mechanism per se, which includes a stationary bushing forming a vertical through-hole for accommodating the second pipe section. A rotary support is mounted for rotation about an axis of the through-hole. A breakout wrench is mounted on the rotary support for rotation therewith and includes a drive socket. The wrench is mounted for movement relative to the rotary support for bringing the drive socket into and out of driving relationship with a drive section of the second pipe section. A third actuating mechanism is operably connected to the wrench for bringing the drive socket into and out of such driving relationship. A fourth actuating mechanism is provided for rotating the rotary support about the axis of the through-hole. The fourth actuating mechanism comprises an extendable/retractable breaker arm having a driving end arranged to be moved from a position out of engagement with the rotary support and into engagement therewith for rotating the rotary support.

BRIEF DESCRIPTION OF THE DRAWINGS

The objects and advantages of the invention will become apparent from the following detailed description of a preferred embodiment thereof in connection with the accompanying drawing in which like numerals designate like elements and in which.

DETAILED DESCRIPTION OF A PREFERRED EMBODIMENT OF THE INVENTION

Figure 1:
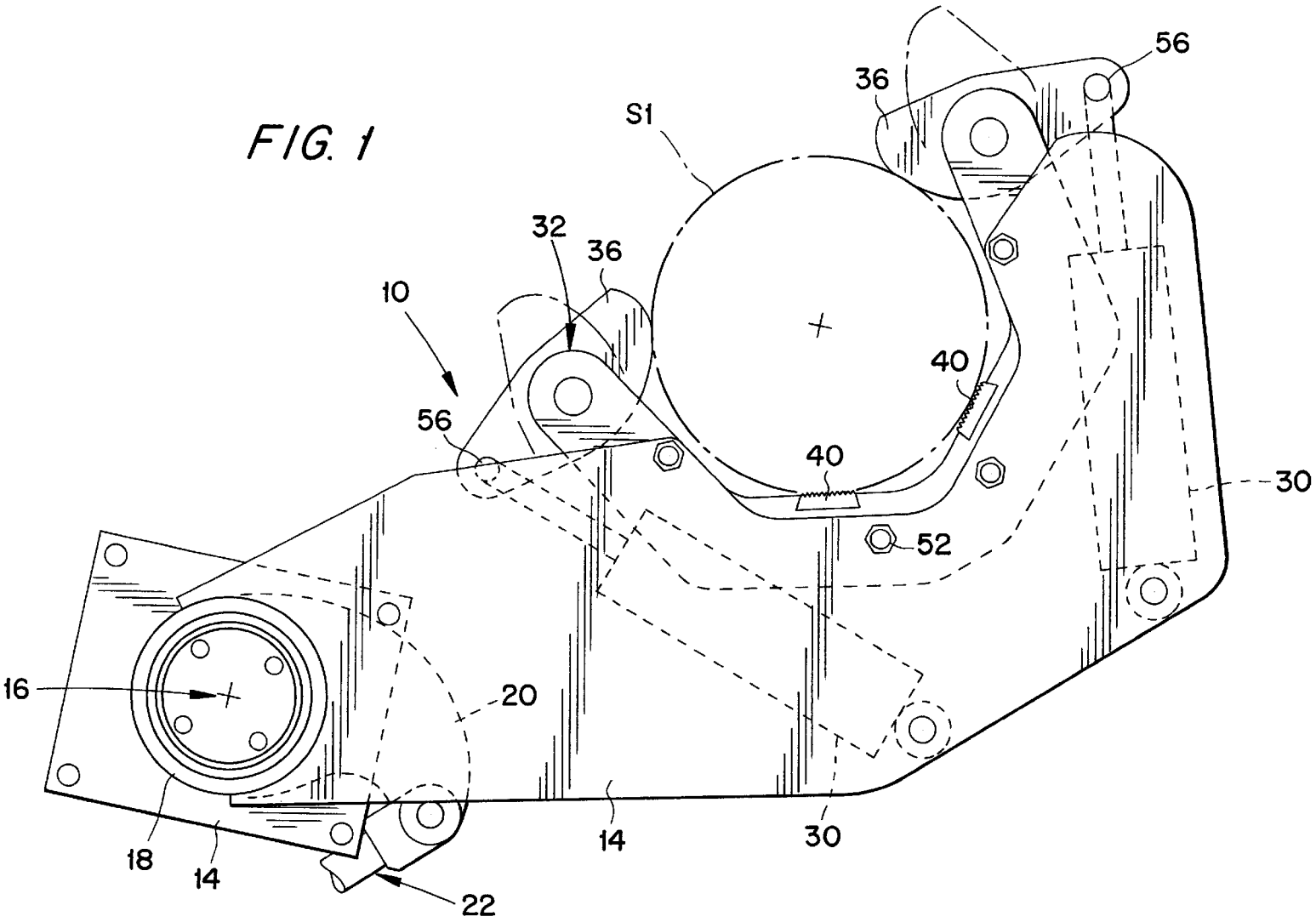
FIG. 1 is a plan view of a clamping arm according to the present invention, while clamping a pipe section against rotation.
Figure 2:
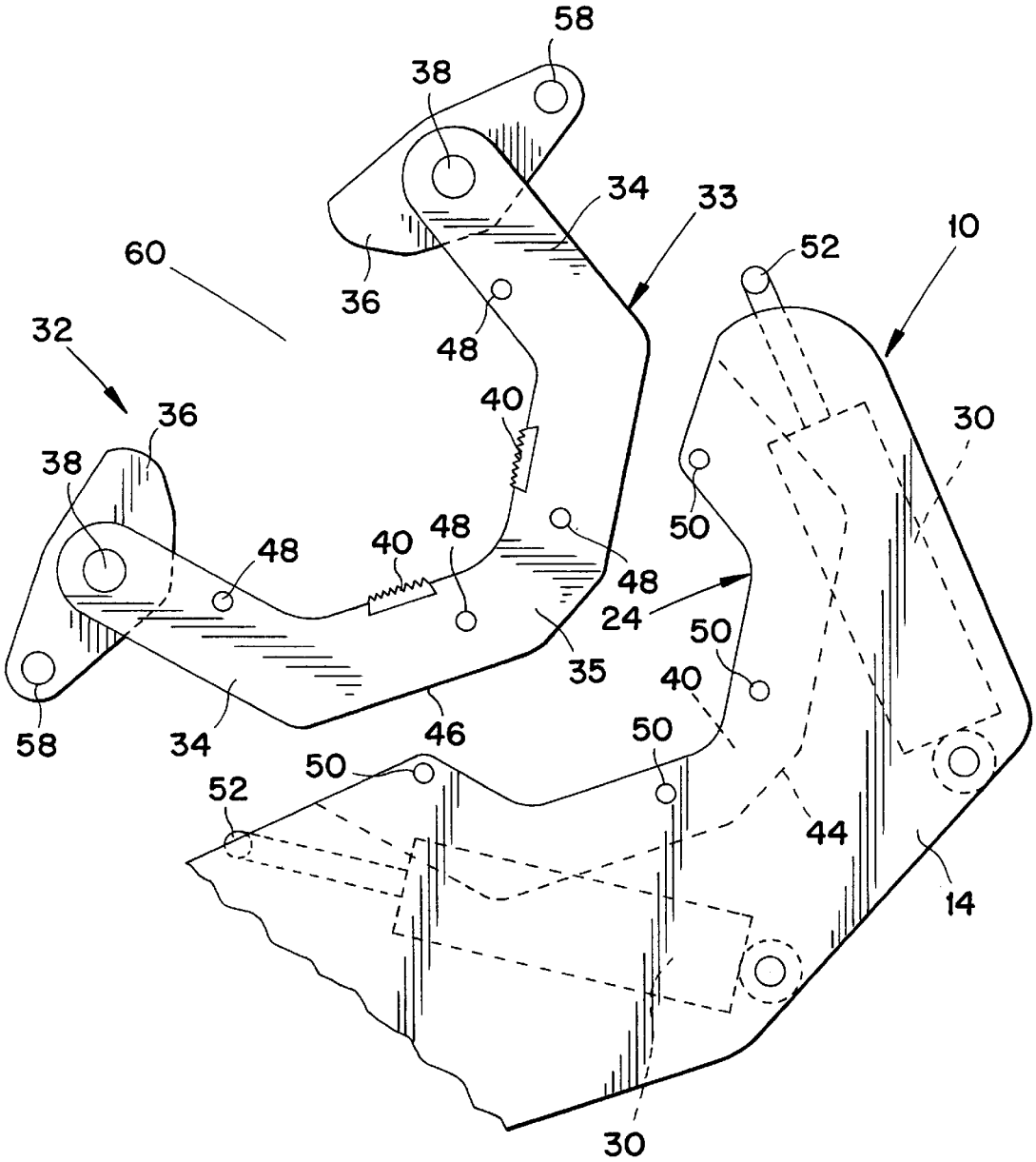
FIG. 2 is an exploded view of the clamping arm depicted in FIG. 1.

A pipe handling mechanism according to the present invention includes a pipe clamping assembly 10 (see FIGS. 1 and 2) for clamping a first threaded pipe section S1 of a drill string against movement, and a turning mechanism 12 (FIGS. 3 and 4) for turning a second threaded pipe section S2, so that a tight bond between the first and second threaded pipe sections can be broken.

Preferably, the clamping assembly 10 is located above the turning mechanism on a drilling rig, but a relationship reverse is also possible. The invention can be employed on a conventional drill rig of the type described earlier herein.

The clamping assembly 10 includes an arm 14 mounted for rotation about a vertical axis 16 defined by a stationary vertical post 18. The arm 14 includes a segment 20 attached to an actuator 22 in the form of a piston/cylinder which rotates the arm 14. The arm includes a recess 24 (see FIG. 2). A pair of actuators 30 in the form of piston/cylinders have one end thereof pivotably mounted on the arm 14.

Removably mounted to the arm 14 is a generally U-shaped adapter 32 which comprises an adapter body 33 and a pair of clamping cams 36 pivotably mounted to the adapter body. The adapter body includes a pair of legs 34 interconnected by a base or bight 35.

The clamping cams 36 are rotatably mounted on free ends of the legs 34 for rotation about respective vertical axes 38. The base 35 carries a pair of serrated inserts or tong dies 40.

The base 35 is removably mounted in a stepped portion 42 of the arm 14 which includes a shoulder 44 against which an edge wall 46 of the base abuts. The base 35 and arm 14 include through-holes 48, 50, respectively, that are vertically alignable with one another for receiving fasteners such as bolts 53 which fixedly secure the adapter 32 to the arm 14. Free ends 52 of piston rods of the piston/cylinders 30 are pivotably connected by any suitable fasteners such as bolts 56, to holes 58 formed in respective clamping cams 36.

The adapter 32 forms a recess 60 that coincides with the recess 24 of the arm 14 when the adapter is affixed to the arm. The recess 60 is dimensioned to receive the first, or upper, pipe section S1. This occurs when the actuators 30 are in a retracted state to position the clamping cams 36 in retracted positions (shown in phantom lines in FIG. 1). By then extending the piston rods of the piston/cylinders 30, the clamping arms are rotated to clamping positions (shown in solid lines in FIG. 1) for clamping the first pipe section S1 against the serrated inserts 40. Consequently, the first pipe section S1 is held stationary.

The adapter is configured to retain a pipe section of a given outer diameter. That is, the spacing between the two legs 34, the location of the serrated inserts 40, and the size of the clamping cams 36 are designed to conform to a given pipe section diameter and provide an optimum clamping thereof.

If pipe sections of different diameter are employed, then the adapter 32 can be detached from the arm 14 and from the actuators 30 and replaced by another adapter suited to the different pipe diameter. Of course, the holes 48 in the new adapter would conform to the location of the holes 50 of the arm to enable the new adapter to be affixed to the arm. While the upper pipe section S1 is held stationary, the lower pipe section S2 is rotated by the turning mechanism 12 depicted in FIGS. 3 and 4.

The turning mechanism 12 includes a rotary support 78 having a downwardly projecting flange 79 which is rotatably mounted in a hole formed in the drill table or platform. A bushing 70 fits into a hole formed in the support 78 and is held against rotation relative to the support 78 in any suitable fashion. The bushing includes a hole 74 through which the drill string moves. The rotary support carries a breakout wrench 80 which is mounted for linear sliding movement toward and away from the hole 74 under the urging of a piston/cylinder 82. The wrench 80 includes a conventional socket 84 adapted to receive a rectangular cross-sectional portion 86 of the second pipe section S2 in order to interconnect the wrench 80 and second pipe section S2 for common rotation in a known manner.

The rotary support 78 includes a lug 90 having an abutment surface defined by mutually angled surface portions 92, 94 forming an apex therebetween.

An actuator 96 in the form of a piston/cylinder has one end thereof pivotably connected to a fixed structure such as a lug 100 attached to the mast of the drilling rig. The cylinder portion is movable within a slot 102 formed in a stationary guide bracket 104. The cylinder portion is normally biased against one end 106 of the slot, e.g. by gravity or a spring (not shown), whereby the driving end 108 of a piston rod 110 is oriented to push against the surface 92 of the lug 90 in response to an extension of the piston/cylinder 96. The driving end 108 is preferably formed by a roller.

In operation, when it is desired to unscrew two of the pipe sections S1, S2 from one another, the usual effort (i.e. "slapping") is performed. That is, the wrench 80 is extended to capture the portion 86 of the second pipe section S2, and a conventional rotary head (not shown) mounted on the mast is coupled to the first pipe section S1 and is reversely rotated whereby both pipe sections are rotated thereby in a counterclockwise direction with reference to FIG. 3. The support 78 rotates with the second pipe section S2 and strikes or slaps against a fixed stop (not shown). This slapping is usually performed a number of times, if necessary, and usually breaks the threaded connection between the pipe sections S1, S2. If not, however, then in accordance with the present invention, the rotary head is placed in neutral, and the actuator 22 is energized to rotate the arm 14 until the first pipe section S1 enters the recess 60 of the adapter 32. Then, the actuators 30 are energized to cause the clamping cams 36 to clamp the first pipe section S1 against the serrated inserts 40.

Figures 3, 4:
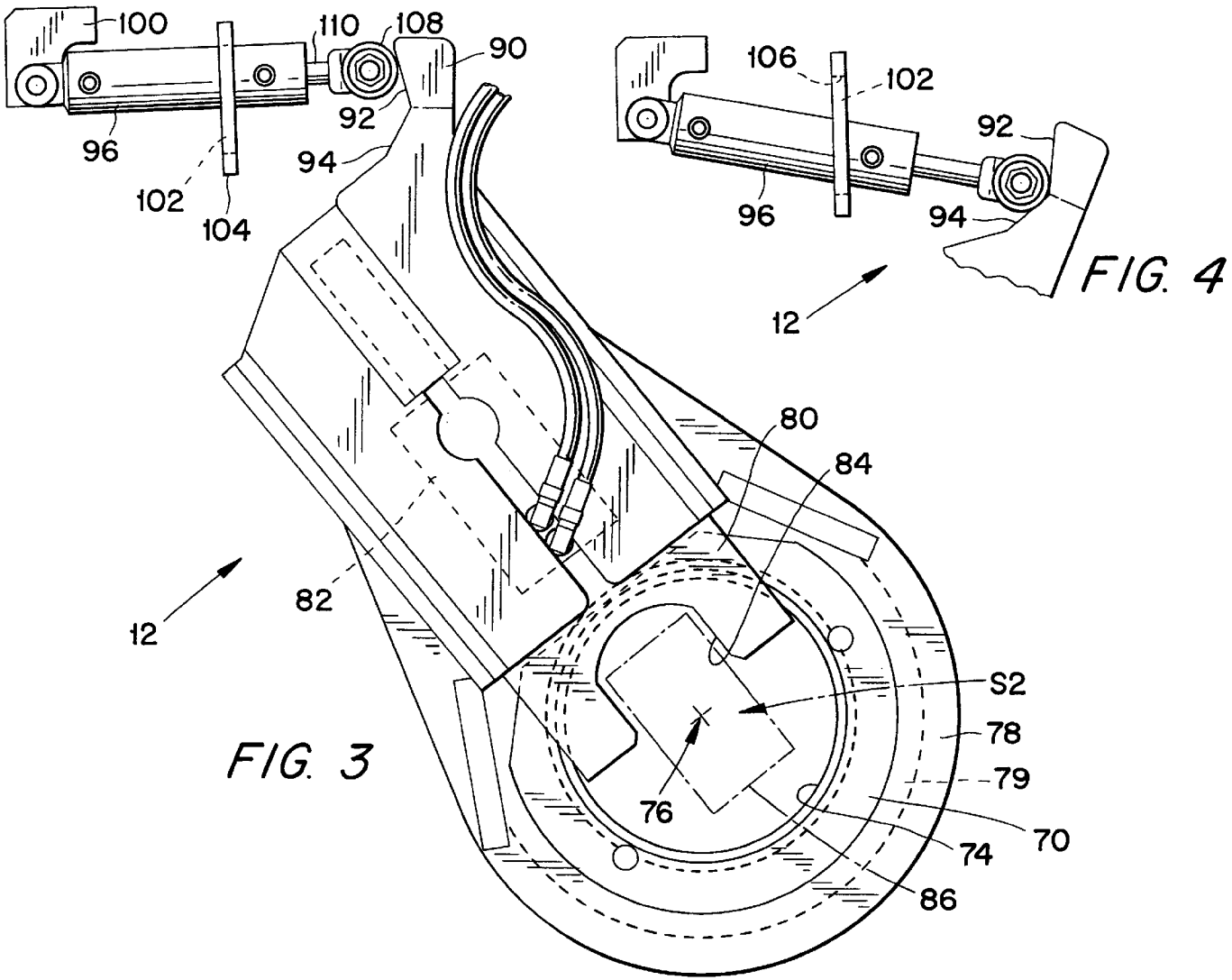
FIG. 3 is a plan view of a turning mechanism according to the present invention.
FIG. 4 is a fragmentary view of FIG. 3 depicting a partial rotation of a turning wrench.

Then, the actuator 96 is extended to cause the roller 108 to push against the lug surface 92. The resulting driving force creates a torque which aids in breaking the bond between the screw threads of the pipe sections. By pushing against the surface 92, a maximum moment is imparted to the second drill pipe section S2. Thereafter, the roller 108 comes to rest in the apex formed between the surfaces 92, 94, as shown in FIG. 4.

The present invention provides an untightening mechanism which is readily adapted to pipe sections of different diameter. Also, an effective means of imparting a breaking impact to the screw thread connected is provided.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. Apparatus for unscrewing first and second threaded sections of a drill string from one another, comprising:

an arm mounted for rotation about a first vertical axis, the arm forming a first recess;

a first actuating mechanism for rotating the arm about the first axis;

an adapter removably mounted on the arm for clamping the first pipe section, the adapter comprising:

a generally U-shaped body including a pair of legs interconnected by a base, the legs spaced apart and defining therebetween a second recess coinciding with the first recess for receiving the first pipe section, the body removably mounted to the arm, the base carrying a pipe-engaging surface;

first and second clamping cams mounted on free ends of respective ones of the legs for rotation about second and third vertical axes, respectively, from a retracted position to a clamping position for clamping the first pipe section immovably against the pipe-engaging surface;

a second actuating mechanism mounted on the arm and removably connectable to the first and second clamping cams for rotating the clamping cams between the retracted and clamping positions;

the adapter being replaceable in response to being disconnected from the arm and from the second actuating mechanism; and a turning mechanism for rotating the second pipe section while the first pipe section is clamped immovably by the arm.

2. The apparatus according to claim 1 wherein the adapter is mounted to the arm by fasteners.

3. The apparatus according to claim 1 wherein the second actuating mechanism comprises first and second piston/cylinder assemblies, each piston/cylinder assembly including a first end pivotably connected to the arm, and a second end pivotably connected to a respective clamping cam.

4. The apparatus according to claim 1 wherein the turning mechanism comprises a stationary bushing forming a vertical through-hole for accommodating the second pipe section, a rotary support mounted for rotation about an axis of the through-hole, a breakout wrench mounted on the rotary support for rotation therewith and including a drive socket, the wrench mounted for movement relative to the rotary support for bringing the drive socket into and out of driving relationship with a drive section of the second pipe section; a third actuating mechanism operably connected to the wrench for bringing the drive socket into and out of such driving relationship; and a fourth actuating mechanism for rotating the rotary support about the axis of the through-hole, the fourth actuating mechanism comprising an extendable/retractable breaker arm having a driving end arranged to be moved from a position out of engagement with the rotary support and into driving engagement therewith for rotating the rotary support.

5. The apparatus, according to claim 4 wherein the third actuating mechanism comprises a piston/cylinder assembly.

6. The apparatus according to claim 4 wherein the fourth actuating mechanism comprises a piston/cylinder assembly including a piston rod; the piston rod defining the breaker arm; the rotary support including a lug having a surface facing the driving end and adapted to be engaged thereby.

7. An apparatus adapted for immovably clamping a threaded pipe section comprising:

an arm mounted for rotation about a first vertical axis, the arm forming a first recess;

a first actuating mechanism for rotating the arm about the first axis;

an adapter removably mounted on the arm for clamping the pipe section, the adapter comprising:

a generally U-shaped body including a pair of legs interconnected by a base, the legs spaced apart and defining therebetween a second recess coinciding with the first recess for receiving the pipe section, the body removably mounted to the arm, the base carrying a pipe-engaging surface;

first and second clamping cams mounted on free ends of respective ones of the legs for rotation about second and third vertical axes, respectively, from a retracted position to a clamping position for clamping the pipe section immovably against the pipe-engaging surface; and a second actuating mechanism mounted on the arm and removably connectable to the first and second clamping cams for rotating the clamping cams between the retracted and clamping positions;

the adapter being replaceable in response to being disconnected from the arm and from the second actuating mechanism.

8. The apparatus according to claim 7 wherein the adapter is mounted to the arm by fasteners.

9. The apparatus according to claim 7 wherein the second actuating mechanism comprises first and second piston/cylinder assemblies, each piston/cylinder assembly including a first end pivotably connected to the arm, and a second end pivotably connected to a respective clamping cam.

10. An apparatus adapted for breaking a threaded connection between threaded pipe sections of a drill string, comprising:

a bushing forming a vertical through-hole for accommodating a pipe section;

a rotary support mounted for rotation about an axis of the through-hole;

a breakout wrench mounted on the rotary support for rotation therewith and including a drive socket, the wrench mounted for movement relative to the rotary support for bringing the drive socket into and out of driving relationship with a drive section of the pipe section;

a third actuating mechanism operably connected to the wrench for bringing the drive socket into and out of such driving relationship; and a fourth actuating mechanism for rotating the rotary support about the axis of the through-hole, the fourth actuating mechanism comprising an extendable/retractable breaker arm having a driving end arranged to be moved from a position out of engagement with the rotary support and into driving engagement therewith for rotating the rotary support.

11. The apparatus, according to claim 10 wherein the third actuating mechanism comprises a piston/cylinder assembly.

12. The apparatus according to claim 10 wherein the fourth actuating mechanism comprises a piston/cylinder assembly including a piston rod; the piston rod defining the breaker arm; the rotary support including a lug having a surface facing the impact end and adapted to be engaged thereby.

* * * * *